US010407266B2

(12) United States Patent
Tokai et al.

(10) Patent No.: US 10,407,266 B2
(45) Date of Patent: Sep. 10, 2019

(54) TRANSPORT APPARATUS AND PRINTER APPARATUS

(71) Applicant: Seiko Epson Corporation, Tokyo (JP)

(72) Inventors: Yoshitsugu Tokai, Shiojiri (JP); Toru Hayashi, Suwa (JP); Ryoichi Onishi, Kobe (JP)

(73) Assignee: Seiko Epson Corporation, Tokyo (JP)

( * ) Notice: Subject to any disclaimer, the term of this patent is extended or adjusted under 35 U.S.C. 154(b) by 533 days.

(21) Appl. No.: 15/067,917

(22) Filed: Mar. 11, 2016

(65) Prior Publication Data

US 2016/0272452 A1 Sep. 22, 2016

(30) Foreign Application Priority Data

Mar. 20, 2015 (JP) ..... 2015-058411

(51) Int. Cl.
*B65H 20/02* (2006.01)

(52) U.S. Cl.
CPC ..... *B65H 20/02* (2013.01); *B65H 2403/514* (2013.01); *B65H 2404/1441* (2013.01); *B65H 2801/36* (2013.01)

(58) Field of Classification Search
CPC ..... B65H 20/02; B65H 2801/36; B65H 2404/1441; B65H 2403/514
See application file for complete search history.

(56) References Cited

U.S. PATENT DOCUMENTS 4,739,341 A * 4/1988 Matsuno ..... B41J 35/16 347/172
4,759,485 A * 7/1988 Braun ..... B21C 47/34 226/176
5,743,663 A * 4/1998 Imai ..... B41J 2/315 347/174
7,004,220 B1 * 2/2006 Rasmussen ..... B41F 16/02 156/540
7,739,952 B2 * 6/2010 Sakamoto ..... B41F 13/02 101/219
8,870,479 B2 * 10/2014 Hayashi ..... B41J 15/16 400/614
8,967,891 B2 * 3/2015 Igarashi ..... B65H 16/10 226/43

(Continued)

FOREIGN PATENT DOCUMENTS

JP 2007-084224 A 4/2007
JP 2007-223680 A 9/2007

(Continued)

*Primary Examiner* — William A. Rivera
(74) *Attorney, Agent, or Firm* — Workman Nydegger

(57) ABSTRACT

A transport apparatus includes a driving roller that transports a medium in a transport direction, a driven roller that presses the medium against the driving roller when the medium is transported, a changer that changes a pressing force by which the driven roller presses the medium against the driving roller, and a feeder configured to feed the medium toward the driving roller and pull back the medium in a direction opposite to the transport direction. Before the driving roller transports the medium, the feeder pulls back the medium after the changer has changed the pressing force to a value that is smaller than the value of the pressing force set for transport of the medium.

5 Claims, 6 Drawing Sheets

(56) References Cited

U.S. PATENT DOCUMENTS

| | | | | |
|---|---|---|---|---|
| 2005/0184455 | A1* | 8/2005 | Youn | B65H 5/06 271/274 |
| 2009/0136281 | A1* | 5/2009 | Fernandez | B41J 3/30 400/618 |
| 2009/0266926 | A1* | 10/2009 | Yoshimaru | B65H 16/06 242/421 |
| 2009/0295067 | A1 | 12/2009 | Yanagishita | |
| 2012/0230749 | A1 | 9/2012 | Hayashi | |
| 2014/0205355 | A1* | 7/2014 | Lo | B41J 13/0009 400/579 |
| 2015/0328906 | A1 | 11/2015 | Sumioka et al. | |

FOREIGN PATENT DOCUMENTS

| | | | |
|---|---|---|---|
| JP | 2009-263088 | A | 11/2009 |
| JP | 2009-286520 | A | 12/2009 |
| JP | 2009-286579 | A | 12/2009 |
| JP | 2012-187751 | A | 10/2012 |
| JP | 2015-218016 | A | 12/2015 |

* cited by examiner

TRANSPORT APPARATUS AND PRINTER APPARATUS

CROSS-REFERENCE TO RELATED APPLICATION(S)

This application claims priority under 35 U.S.C. § 119 on Japanese Patent Application No. 2015-058411, filed Mar. 20, 2015. The content of this priority application is incorporated by reference in its entirety.

BACKGROUND

1. Technical Field

The present invention relates to a transport apparatus that transports a medium and a printing apparatus that includes the transport apparatus.

2. Related Art

A printer, which is an example of the printing apparatus, includes a transport apparatus that resolves a skew in which a printing medium is oblique to a transport direction by reversely rotating pairs of transport rollers that nip a leading edge of the medium so as to push the leading edge of the medium against the transport roller pairs, causing the medium to flexibly bend (see, e.g., JP-A-2009-286579).

However, for example, in the case where a rolled paper is used as a medium and a portion of the paper having been subjected to printing is manually cut by a user with a cutting blade or the like, the cut leading edge of the medium is sometimes not a straight line orthogonal to the side edges of the medium. If that happens, there arises a problem that pushing the leading edge of the medium against the transport roller pairs will not resolve the skew of the medium. In addition to the skew of the medium relative to the transport direction, the medium may sometimes bend and lift off the transport path. Such a distorted posture of the medium leads to deviation of printing position on the medium and therefore degradation of print quality.

This problem is not limited to transport apparatuses used in printers but is substantially common in the transport apparatuses and printing apparatuses in which a medium is nipped when transported.

SUMMARY

An advantage of some aspects of the invention is that the posture of a medium in a transport apparatus and a printing apparatus can be made appropriate (hereinafter, also termed "adjusted") regardless of the shape of a leading edge of the medium.

Configurations and operations of the transport and printing apparatuses according to the invention will be described below.

A transport apparatus according one aspect of the invention includes a driving roller that transports a medium in a transport direction, a driven roller that presses the medium against the driving roller when the medium is transported, a changer that changes a pressing force by which the driven roller presses the medium against the driving roller, and a feeder configured to feed the medium toward the driving roller and pull back the medium in a direction opposite to the transport direction. Before the driving roller transports the medium, the feeder pulls back the medium after the changer has changed the pressing force to a value that is smaller than the value of the pressing force set for transport of the medium.

According to this configuration, for example, when the medium is set in the transport path with the leading edge portion of the medium being oblique to the transport direction or being bent, the posture of the medium can be made appropriate and substantially straight in the transport direction (i.e., adjusted) by the feeder pulling back the medium. If, at this time, the driven roller is apart from the driving roller, the medium will be pulled back while remaining bent and thus cannot assume an appropriate posture. On another hand, if the pressing force of the driven roller on the medium is large, the pull-back of the medium is impeded. In the transport apparatus of the invention, however, when the feeder pulls back the medium, the driven roller presses the medium against the driving roller by a pressing force that is smaller than the pressing force exerted during the transport of the medium, so that it is possible to smoothly pull back the medium while correcting the posture of the medium. Since the feeder pulls back the medium while the medium is nipped between the driving roller and the driven roller, the posture of the medium can be adjusted (i.e., made appropriate) regardless of the shape of the leading edge of the medium.

The foregoing transport apparatus may further include a controller that controls the driving roller and the feeder, the feeder rotatably may hold a roll body that has the medium in a rolled form, and, as an operation of adjusting a posture of the medium, the controller may cause the driving roller and the feeder to execute the transport of the medium over a predetermined distance in the transport direction based on an amount of rotation of the driving roller and then may cause the driving roller and the feeder to execute pull-back of the medium over the predetermined distance based on the amount of rotation of the roll body.

According to this configuration, when the medium is transported in the transport direction, the transport distance of the medium is controlled on the basis of the amount of rotation of the driving roller disposed downstream of the feeder in the transport direction, so that the medium can be transported without causing the medium to bend. On the other hand, when the medium is pulled back, the pull-back distance of the medium is controlled on the basis of the amount of rotation of the roll body held by the feeder, so that the medium can be pulled back without causing the medium to bend and without excessively pulling back the medium so that the medium escapes the nip between the driving roller and the driven roller. As the feeder pulls back and rewinds the medium onto the roll body, the bend of the medium can be removed and the skew of the medium can be corrected.

In the transport apparatus, the changer may include a spring that provides the pressing force when stretched. When the feeder pulls back the medium, the changer may change the pressing force to a value that corresponds to the initial tension of the spring.

According to this configuration, the spring has an initial tension and does not stretch unless a load larger than the initial tension is applied. Thus, in order to stretch the spring from the natural length to obtain a pressing force, it is necessary to apply a larger load to this spring than a spring that does not have an initial tension. Therefore, even when a small pressing force needs to be provided, the load that needs to be applied to the spring in order to provide the needed pressing force is greater than the initial tension of the spring. Therefore, it is easier to adjust the load in this case than in the case where a small load substantially equal to the small pressing force is applied to a spring. Therefore, by setting the pressing force for the pull-back to a value that corresponds to the initial tension of the spring, a small pressing force onto the medium can be accurately set. Note that the initial tension refers to an internal force that acts in the spring in a no-load state of the spring.

In the foregoing transport apparatus, the changer may include a cam member, a spring that provides the pressing force when stretched, a pivoting member that supports the driven roller for pivotal movement, retains a first end of the spring, and is pivotable about a pivot shaft, and a retaining member whose proximal end is supported for pivotal movement by the pivoting member and whose distal end is retaining a second end of the spring and which, when receiving between the proximal end and the distal end a pressurizing force of the cam member, pivots about the proximal end in such a direction that the distal end stretches the spring. Furthermore, the retaining member may be supported by the pivoting member in such a manner that position of the proximal end is changeable without changing the length of the spring.

According to this configuration, since the spring is stretched as the retaining member is pivoted by the pressurizing force from the cam member, the changer can change the pressing force due to operation of the cam member. To produce the pressing force as described above, the retaining member functions as a "lever" whose point of effort is in a portion of the retaining member that receives the pressurizing force from the cam member and whose fulcrum is in a proximal end of the retaining member and whose point of load is in a distal end of the retaining member. Therefore, if the position of the proximal end (fulcrum) supported by the pivoting member is changed, the distance between the point of effort and the point of load changes. Therefore, even when the cam member pressurizes the point of effort with a fixed pressurizing force, it is possible to adjust the length of stretch of the spring, that is, adjust the pressing force, by changing the force that acts at the point of load. On the other hand, if the position of the proximal end of the retaining member is changed, the length of the spring does not change. Therefore, the range of change of the pressing force is small when the spring provides a small pressing force without stretching to a considerable extent. Therefore, even when the position of the proximal end of the retaining member is changed, the change in the weak pressing force for pulling back the medium can be restrained.

A printing apparatus according to a second aspect of the invention includes the transport apparatus as described above and a printer that performs printing on the medium transported by the transport apparatus.

According to this configuration, because the transport apparatus operates so as to adjust the posture of the medium, degradation of the accuracy of printing on the medium can be inhibited.

DESCRIPTION OF EXEMPLARY EMBODIMENTS

Exemplary embodiments of the printing apparatus will be described hereinafter with reference to the drawings. The printing apparatus herein is, for example, a large-format printer that performs printing (recording) on an elongated medium.

Figure 1:
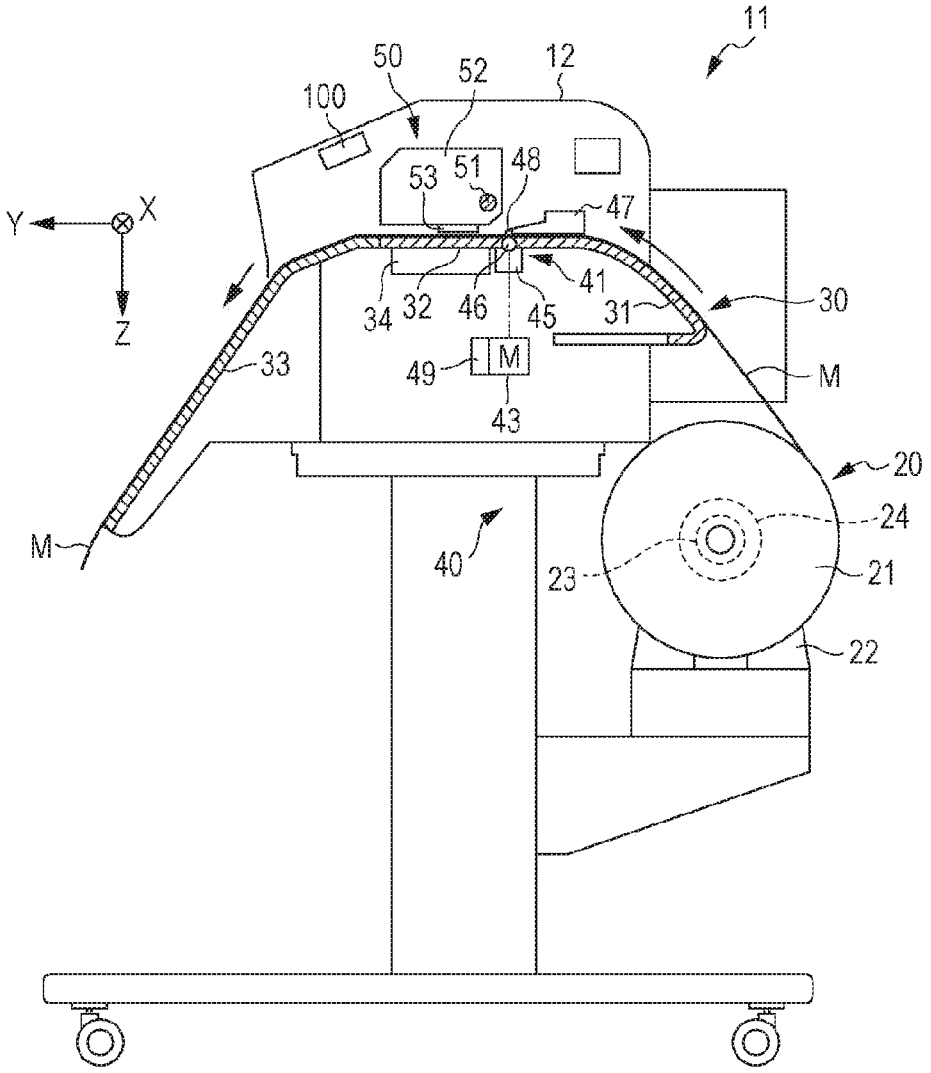
FIG. 1 is a schematic sectional view of an exemplary embodiment of the transport apparatus and the printing apparatus of the invention.

As shown in FIG. 1, a printing apparatus 11 includes a casing portion 12, a support portion 30 that supports a medium M, a transport apparatus 40 that transports the medium M in a direction indicated by arrows in FIG. 1, and a printer 50 that performs printing on the medium M within the casing portion 12.

In the following description, a direction along a width direction orthogonal to a length direction of the medium M (a direction orthogonal to the plane of FIG. 1) is defined as a scanning direction X, and a direction in which the medium M is transported at a location at which the printer 50 performs printing is defined as a transport direction Y. In this exemplary embodiment, the scanning direction X and the transport direction Y intersect each other (preferably, orthogonally) and both intersect a gravity direction Z (preferably, orthogonally).

The support portion 30 includes a first support portion 31, a second support portion 32, and a third support portion 33 that form a transport path of the medium M, and also includes a suction mechanism 34 disposed below the second support portion 32. The first support portion 31 has an inclined surface that is inclined so that a downstream side of the inclined surface in the transport direction Y is higher than an upstream side thereof. The second support portion 32 is provided at a position that faces the printer 50, and supports the medium M on which printing is performed. The third support portion 33 has an inclined surface that is inclined so that a downstream side of the inclined surface in the transport direction Y is lower than an upstream side thereof. The third support portion 33 guides the medium M on which the printer 50 has performed printing.

The printer 50 includes a guide shaft 51 extending in the scanning direction X, a carriage 52 supported by the guide shaft 51, and a liquid ejection portion 53 that ejects to the medium M an ink as an example of liquid. The carriage 52 is moved back and force along the guide shaft 51 extending in the scanning direction X by driving a carriage motor (not shown in the drawings). The liquid ejection portion 53 is supported by the carriage 52 so as to face the medium M supported by the second support portion 32. The printer 50 performs a printing operation of forming images of characters or graphic images on the medium M by ejecting the ink from the liquid ejection portion 53 onto the medium M while the carriage 52 is being moved along the scanning direction X.

The second support portion 32 has a plurality of suction holes (not shown) in a support surface on which the medium M is supported. Due to suction via the suction holes caused by driving the suction mechanism 34, the medium M is drawn to the support surface, so that the medium M subjected to printing is restrained from lifting off the support surface. Furthermore, because the suction mechanism 34 is driven also when the medium M is transported, the medium M is restrained from lifting off and therefore contacting the liquid ejection portion 53.

Next, a configuration of the transport apparatus 40 will be described in detail.

The transport apparatus 40 includes transport roller pairs 41 provided between the first support portion 31 and the second support portion 32 in the transport direction Y and further includes a transport motor 43 and a controller 100 that controls component elements of the transport apparatus 40. In this exemplary embodiment, the controller 100 is configured as a controller that controls component elements of the printing apparatus 11. In the exemplary embodiment, the rotation axis direction of the transport roller pairs 41 is along the scanning direction X.

Each transport roller pair 41 is made up of a pair of a driving roller 46 supported on a support table 45 and a driven roller 48 supported on a changer 47. By driving the transport motor 43, the driving rollers 46 are rotated in a first rotation direction (the counterclockwise direction in FIG. 1) such that the medium M is transported in the transport direction Y and in a second rotation direction (the clockwise direction in FIG. 1) such that the medium M is moved back in the direction opposite to the transport direction Y. The transport apparatus 40 includes a rotary encoder 49 for detecting the amount of rotation of the driving rollers 46 in the first rotation direction and in the second rotation direction.

As for the transport roller pairs 41, the medium M is nipped between the driving rollers 46 and the driven rollers 48 by the driven rollers 48 pressing the medium M against the driving rollers 46. The changers 47 change the pressing force of the driven rollers 48. By rotating the driving rollers 46 in the first rotation direction while the transport roller pairs 41 nip the medium M, the medium M is transported in the transport direction Y.

The transport apparatus 40 includes a feeder 20 that feeds the medium M toward the driving rollers 46 when the transport roller pairs 41 transport the medium M in the transport direction Y. The feeder 20 includes a holder portion 22 that rotatably holds a roll body 21 in which the medium M has been rolled, a feed motor 23 for rotating the roll body 21 in both directions, that is, a feed direction (the counterclockwise direction in FIG. 1) and a pull-back direction (the clockwise direction in FIG. 1), and a rotary encoder 24 for detecting the amount of rotation of the roll body 21.

The holder portion 22 is capable of holding a plurality of kinds of roll bodies 21 that vary in the length in the scanning direction X and the number of turns. The feeder 20 rotates the roll body 21 in the feed direction to feed the medium M toward the driving rollers 46 and rotates the roll body 21 in the pull-back direction to pull back the medium M in the direction opposite to the transport direction Y and rewind the medium M onto the roll body 21.

Figure 2:
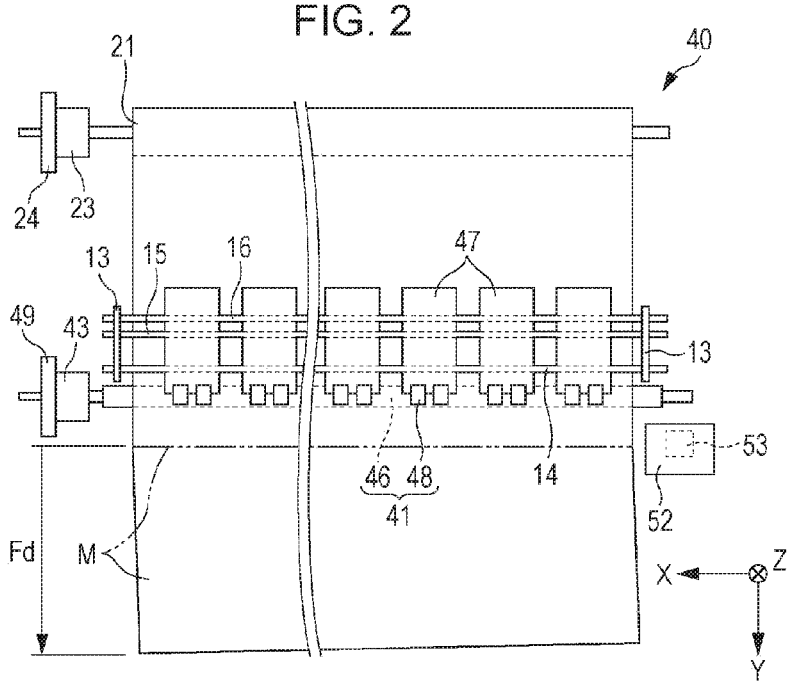
FIG. 2 is a plan view schematically showing a configuration of a transport apparatus.

As shown in FIG. 2, a plurality of (e.g., twenty) changers 47 are provided in the scanning direction X, supported on a pivot shaft 14 extending between support frames 13 provided at outer sides of the transport path of the medium M. Each changer 47 supports one or more driven rollers 48 so that the one or more driven rollers 48 are freely pivotably movable. Incidentally, the number of changers 47 provided and the number of driven rollers 48 that each changer 47 supports can be changed as desired.

The support frames 13 pivotably support a release shaft 15 at a location upstream of the pivot shaft 14 in the transport direction Y and also pivotably support an adjusting shaft 16 at a location upstream of the release shaft 15 in the transport direction Y. The release shaft 15 and the adjusting shaft 16 are pivoted by drive force provided by a cam motor 17 (see FIG. 9).

Figure 3:
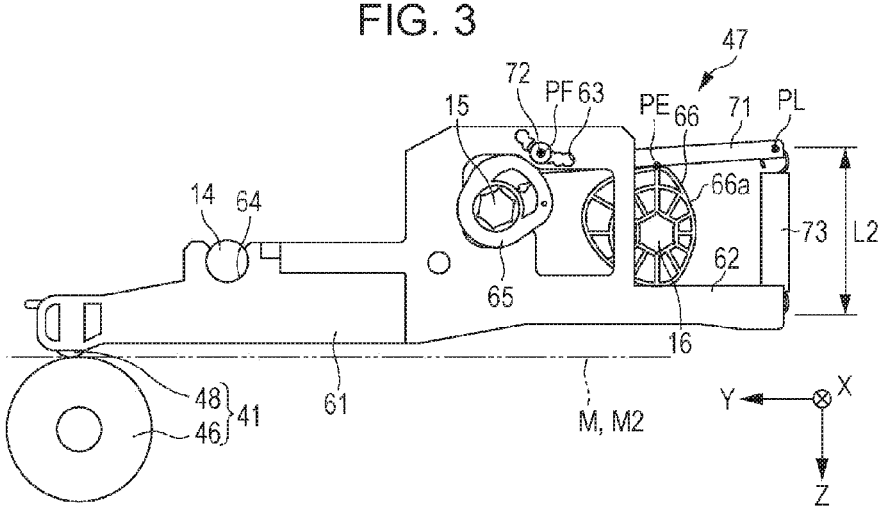
FIG. 3 is a side view of the transport apparatus when a retaining member is disposed at a second pressing position.

As shown in FIG. 3, each changer 47 includes a spring 73 that, when stretched, provides a pressing force of the driven rollers 48 against the driving rollers 46, a pivoting member 61 mounted pivotably on the pivot shaft 14 via an engaging portion 64, a retaining member 71 supported pivotably on the pivoting member 61, a release cam 65 mounted on the release shaft 15, and a cam member 66 mounted on the adjusting shaft 16.

As for the pivoting member 61 supported by the pivot shaft 14, a downstream-side end in the transport direction Y supports the driven rollers 48 for free circular motions, and an extension portion 62 provided in an upstream side end in the transport direction Y is connected to a first end (lower end) of the spring 73. Furthermore, the pivoting member 61 has an adjusting elongated hole 63 at a site between the engaging portion 64 and the cam member 66 in the transport direction Y that is a longitudinal direction.

A proximal end of the retaining member 71 (a left end thereof in FIG. 3) is supported so as to be freely pivotably movable on the pivoting member 61 via a pin 72 inserted into the adjusting elongated hole 63, and a distal end of the retaining member 71 (a right end thereof in FIG. 3) retains a second end (upper end) of the spring 73. Incidentally, the retaining member 71 is mounted at a site in the pivoting member 61 which is above the extension portion 62.

In each changer 47, the pivoting member 61 has, in its proximal end side that is an upstream side of the pivot shaft 14 in the transport direction Y, an engaging portion (not shown in the drawings) that is engageable with the release cam 65. When the release cam 65 is rotated from a position shown in FIG. 3 to a position shown in FIG. 4 due to rotation of the release shaft 15, the release cam 65 pushes the engaging portion down while stretching the spring 73. Therefore, the pivoting member 61 pivots in the clockwise direction in FIGS. 3 and 4 about the pivot shaft 14, moving the driven rollers 48 from a nipping position at which the driven rollers 48 and the driving roller 46 nip the medium M to a release position shown in FIG. 4.

Figure 4:
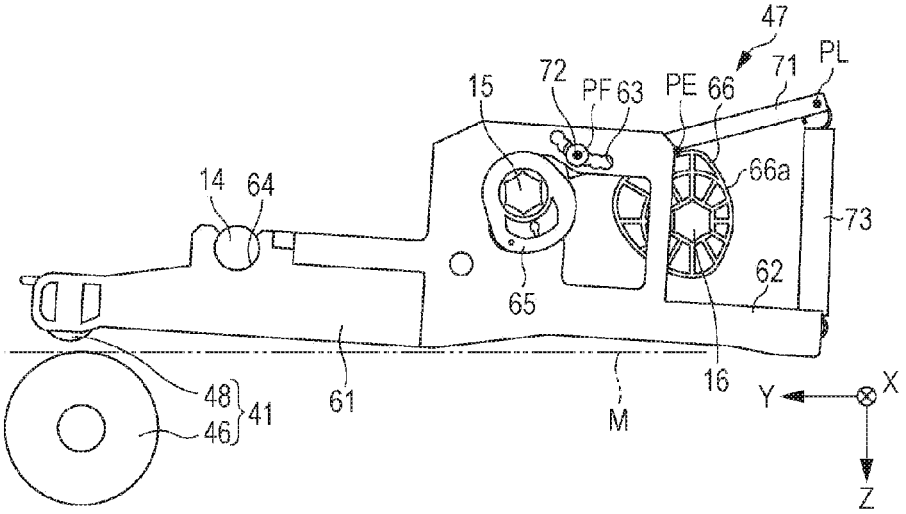
FIG. 4 is a side view of the transport apparatus when driven rollers are positioned at a release position.

As shown in FIG. 4, when the driven rollers 48 are moved to the release position, the driven rollers 48 leave the driving roller 46, discontinuing the nipping of the medium M. For example, if the medium M is stuck in the transport path, the driven rollers 48 are moved to the release position to perform a maintenance operation such as removal of the medium M.

The spring 73 is preferred to be a tension spring and more preferred to be a tension coil spring that, even in a no-load state, has a force (initial tension=Nf) acting in such a direction that each loop of the coil will closely contact the adjacent loops. Such a tension coil spring can be formed, for example, by cold forming or the like so that the wire of the coil is given a torsion that acts in such a direction as to bring adjacent loops of the coil into close contact. In this case, the spring 73 has a natural length when most contracted by the initial tension, and does not stretch from the natural length unless the spring 73 is subjected to a load greater than the initial tension.

The cam member 66 has a cam surface **66*a* whose distance from the adjusting shaft 16 continuously changes. The cam member 66 is disposed so that the cam surface 66*a*** contacts a portion of the retaining member 71 between the proximal end and the distal end of the retaining member 71. When the retaining member 71 receives, between the proximal end and the distal end in the transport direction Y, a pressurizing force from the cam member 66, the retaining member 71 pivots about the pin 72 inserted in the proximal end in such a pivot direction that the spring 73 is stretched.

In this operation, the retaining member 71 functions as a "lever" that has a point of effort PE in a portion of the retaining member 71 that receives the pressurizing force from the cam member 66, a fulcrum PF in the proximal end, and a point of load PL in the distal end. If the spring 73 is stretched by the retaining member 71 receiving the pressurizing force from the cam member 66 when the driven rollers 48 are at the nipping position, there occurs a pressing force by which the driven rollers 48 supported by the distal end of the pivoting member 61 are caused to press the medium M against the driving roller 46. Since the urging force output when the spring 73 is stretched acts as a pressing force of the driven rollers 48 as described above, the pressing force of the driven rollers 48 becomes stronger the greater the stretched length of the spring 73.

If the cam member 66 rotates and the position of contact of the cam surface 66*a* with the pivoting member 61 changes when the driven rollers 48 are at the nipping position, the pressurizing force by which the cam surface 66*a* pressurizes the retaining member 71 changes and therefore the length of the spring 73 can change stepwise as follows. For example, according to a design in this exemplary embodiment, the length of the spring 73 changes in four steps (L0<L1<L2<L3), so that the pressing force of the driven rollers 48 changes stepwise. For example, when the length of the spring 73 changes in four steps of L0, L1, L2, and L3, the pressing force N of the driven rollers 48 correspondingly changes in four steps of N0, N1, N2, and N3 (N0<N1<N2<N3).

Note that since the point of effort PE of the retaining member 71 is between the fulcrum PF and the point of load PL, the pressurizing force that acts at the point of effort PE causes the point of load PL to move a greater distance (with a smaller force) than the point of effort PE and accordingly stretch the spring 73. Therefore, the changers 47 are capable of finely adjusting the pressing force of the driven rollers 48 according to the kinds of the media M that vary in, for example, thickness, surface smoothness, resilience, etc.

Figure 5:
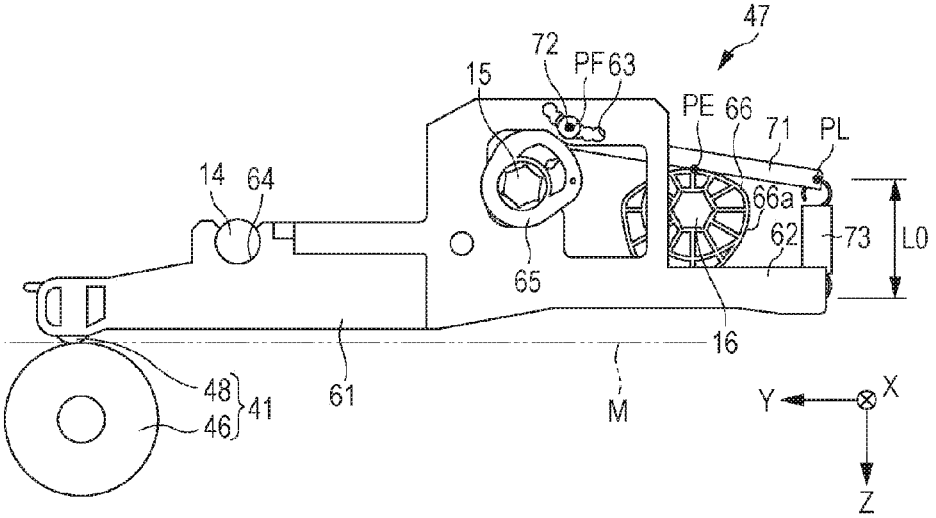
FIG. 5 is a side view of the transport apparatus when the retaining member is positioned at a weak pressing position.
Figure 6:
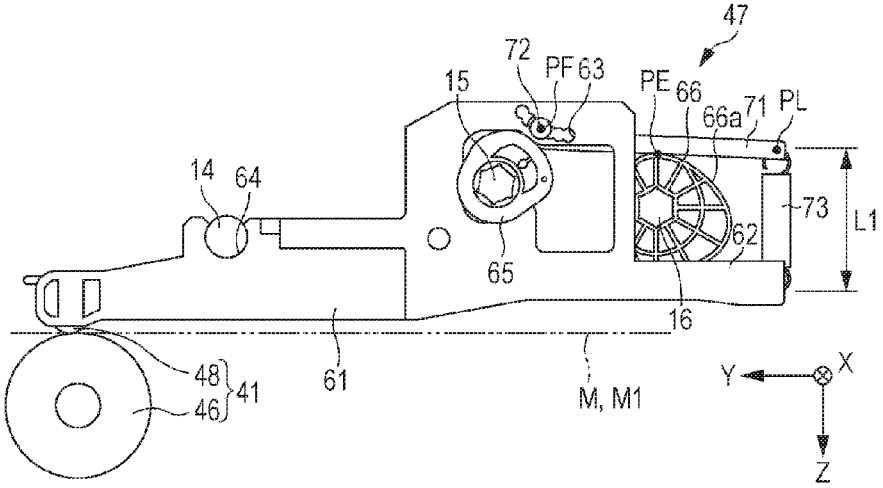
FIG. 6 is a side view of the transport apparatus when the retaining member is positioned at a first pressing position.
Figure 7:
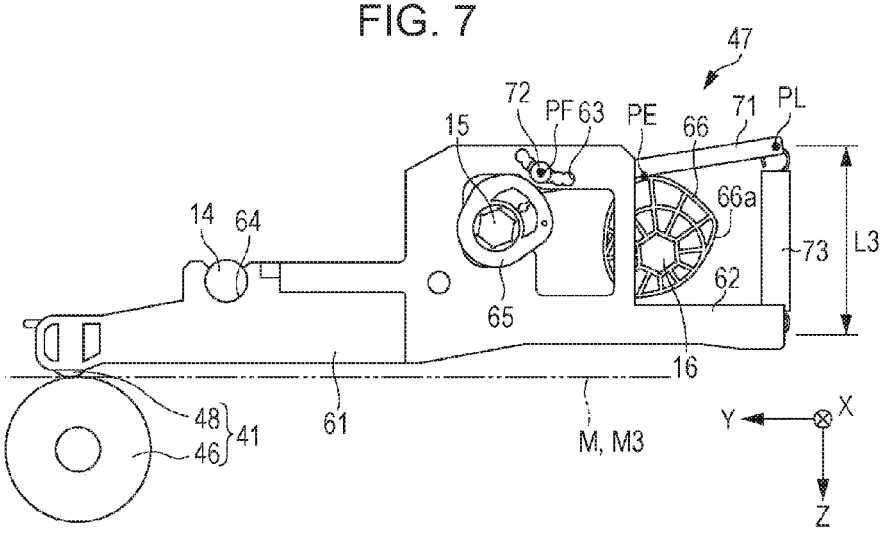
FIG. 7 is a side view of the transport apparatus when the retaining member is positioned at a third pressing position.

In this exemplary embodiment, the position of the retaining member 71 when the length of the spring 73 is L0 as shown in FIG. 5 is referred to as weak pressing position, the position of the retaining member 71 when the length of the spring 73 is L1 as shown in FIG. 6 is referred to as first pressing position, the position of the retaining member 71 when the length of the spring 73 is L2 as shown in FIG. 3 is referred to as second pressing position, and the position of the retaining member 71 when the length of the spring 73 is L3 as shown in FIG. 7 is referred to as third pressing position. Note that when the driven rollers 48 are positioned at the release position shown in FIG. 4, the spring 73 is stretched to a length greater than L3.

When the retaining member 71 assumes the weak pressing position, the first pressing position, the second pressing position, or the third pressing position, the driven rollers 48 are positioned at the nipping position at which the driven rollers 48 and the driving roller 46 nip the medium M therebetween. When the position of the retaining member 71 is changed, for example, from the weak pressing position to the third pressing position, the position of the pivoting member 61 remains unchanged because the driven rollers 48 remain in contact with the driving roller 46 or the medium M but the pressing force of the driven rollers 48 changes (increases) because the position of the retaining member 71 changes so that the spring 73 is stretched. Therefore, the cam member 66 is rotated according to the kind of the medium M so that the changer 47 changes the position of the retaining member 71 and therefore changes the pressing force of the driven rollers 48.

As shown in FIG. 5, when the retaining member 71 is in the weak pressing position, the length of the spring 73 is L0 and the pressing force of the driven rollers 48 is N0. Where the natural length of the spring 73 without any load is represented by Ln and an average or representative thickness of the medium M is presented by Mt, it is preferable that L0=Ln+Mt+$\alpha$ (where $\alpha$ is a smallest possible value, e.g., 1 mm). In this case, the pressing force N0 of the driven roller 48 when the retaining member 71 is in the weak pressing position is a value that corresponds to the initial tension Nf of the spring 73.

As shown in FIG. 6, when the retaining member 71 is in the first pressing position, the length of the spring 73 is L1 and the pressing force of the driven rollers 48 is N1. For example, when a thin or low-resilience medium M (M1), such as banner paper, is transported, it is preferable that the changers 47 change the pressing force of the driven rollers 48 to N1.

As shown in FIG. 7, when the retaining member 71 is in the third pressing position, the length of the spring 73 is L3 and the pressing force of the driven rollers 48 is N3. When a thick or a high-resilience medium M (M3), such as a film of polyvinyl chloride resin, is to be transported, it is preferable that the changers 47 change the pressing force of the driven rollers 48 to N3.

Furthermore, as shown in FIG. 3, when the retaining member 71 is in the second pressing position, the length of the spring 73 is L2 and the pressing force of the driven rollers 48 is N2. For example, if the thickness or resilience of the medium M (M2) is at an intermediate level between those of the medium M1 and the medium M3, it is preferable that the changers 47 change the pressing force of the driven rollers 48 to N2.

Note that it is preferable to adopt a configuration in which the retaining member 71 be supported by the pivoting member 61 in such a manner that the position of the proximal end of the retaining member 71 supported by the pivoting member 61 can be changed without changing the length of the spring 73.

Figure 8:
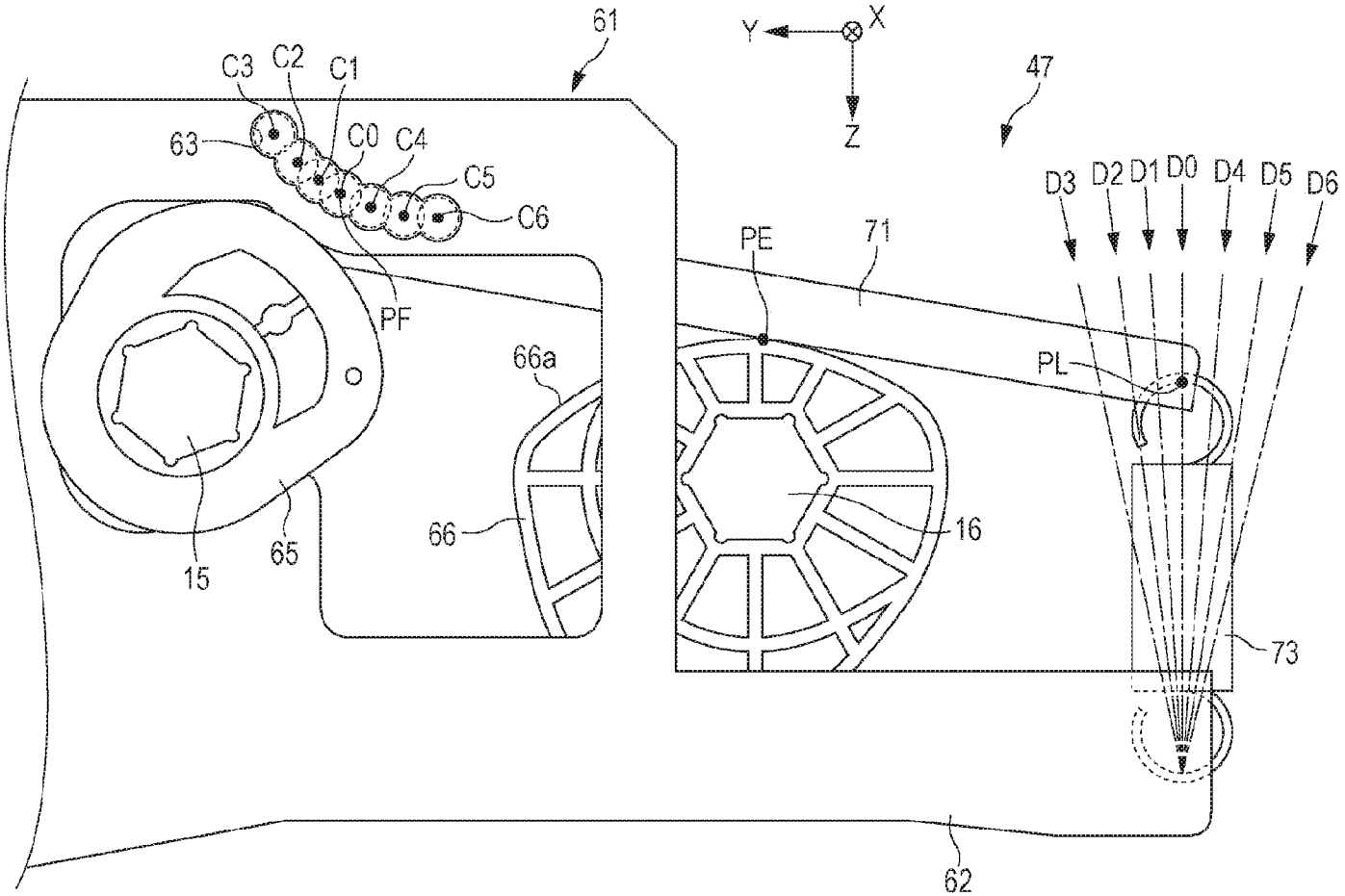
FIG. 8 is a side view indicating changes of the positions of the retaining member and a spring relative to a pivoting member.

For example, as shown in FIG. 8, the adjusting elongated hole 63 is formed so that the pivot center of the pin 72 can be moved from a reference center position C0 to a plurality of sites (in this exemplary embodiment, six sites that are a first center position C1, a second center position C2, a third center position C3, a fourth center position C4, a fifth center position C5, and a sixth center position C6).

In the adjusting elongated hole 63, the center positions C0 to C6 at which the pivot center of the pin 72 is disposed are side by side with intervals therebetween along the transport direction Y. Therefore, if the position of the pin 72 that is the fulcrum PF of the retaining member 71 that functions as a lever is moved within the adjusting elongated hole 63, the distance from the fulcrum PF to the point of effort PE and the distance from the point of effort PE to the point of load PL change.

For example, when the pin 72 is moved from the reference center position C0 to any one of the center positions C1 to C3 set downstream of the reference center position C0 in the transport direction Y, the distance from the fulcrum PF to the point of effort PE increases and the distance from the point of effort PE to the point of load PL decreases. On the other hand, when the pin 72 is moved from the reference center position C0 to any one of the center positions C4 to C6 set upstream of the reference center position C0 in the transport direction Y, the distance from the fulcrum PF to the point of effort PE decreases and the distance from the point of effort PE to the point of load PL increases.

Furthermore, the center positions C0 to C6 have been set different from each other in the gravity direction Z that intersects the transport direction Y so that when the position of the proximal end of the retaining member 71 is moved together with the pin 72 from one to another of the central positions C0 to C6, the length of the spring 73 does not change. Therefore, when the position of the pin 72 that serves as the pivot center of the retaining member 71 is moved within the adjusting elongated hole 63, the inclination of the spring 73 changes as the retaining member 71 undergoes tilting movement about the point of effort PE.

For example, when the pin 72 is at the reference center position C0 and the center axis of the spring 73 is in a vertical position D0 shown in FIG. 8, a movement of the pin 72 from the reference center position C0 to the center position C1, C2 or C3 will incline the center axis of the spring 73 (or the first end (upper end) of the spring 73) about the second end (lower end) thereof from the vertical position D0 to an inclined position D1, D2 or D3, respectively, that are downstream of the vertical position D0 in the transport direction Y. On the other hand, a movement of the pin 72 from the reference center position C0 to the center position C4, C5 or C6 will incline the center axis (or the first end (upper end)) of the spring 73 about the second end (lower end) thereof from the vertical position D0 to an inclined position D4, D5 or D6, respectively, that are upstream of the vertical position D0 in the transport direction Y. In such a movement, the inclination of the spring 73 from the vertical position D0 changes the height position of the upper end of the spring 73 but the length of the spring 73 remains unchanged.

Thus, when the pin 72 is displaced within the adjusting elongated hole 63 to change the position of the retaining member 71 relative to the pivoting member 61 and the cam member 66, the force that the retaining member 71 exerts on the spring 73 when the point of effort PE of the retaining member 71 receives the pressurizing force from the cam member 66 changes and therefore the pressing force of the driven rollers 48 changes.

Concretely, as for the retaining member 71 that functions as a lever, if the distance from the point of effort PE to the point of load PL decreases, the difference between the pressurizing force exerted at the point of effort PE and the force that acts at the point of load PL (force that stretches the spring 73) reduces. In consequence, if the pin 72 is gradually moved from the reference center position C0 to the center positions C1 to C3, the force that acts at the point of load PL reduces stepwise and, therefore, the pressing force of the driven rollers 48 reduces stepwise. If the pin 72 is gradually moved from the reference center position C0 to the center positions C4 to C6, the force that acts at the point of load PL increases stepwise and, therefore, the pressing force of the driven roller 48 increases stepwise.

For example, when, due to bending of the pivot shaft 14 that supports the plurality of changers 47, or the like, the height positions of the changers 47 supported by the pivoting member 61 vary in the scanning direction X, the pressurizing forces of the driven rollers 48 become non-uniform in the scanning direction X. Therefore, it is preferable to adjust the positions of the retaining members 71 of the changers 47 before use of the printing apparatus 11 or the like by adjusting the position of the pin 72 of each changer 47 so that the pressing forces of the plurality of driven rollers 48 become equal.

By thus adjusting the position of the pin 72 in each changer 47, the spring 73 is inclined and therefore the height of the upper end thereof (the position thereof in the gravity direction) changes, so that errors of the height of the pivoting member 61 can be corrected. Since the spring 73 does not change in length (remains at the natural length) despite being inclined, the length L0 of the spring 73 and the pressing force N0 of the driven rollers 48 when the retaining member 71 is at the weak pressing position are inhibited from changing.

Next, an electrical configuration of the printing apparatus 11 will be described.

Figure 9:
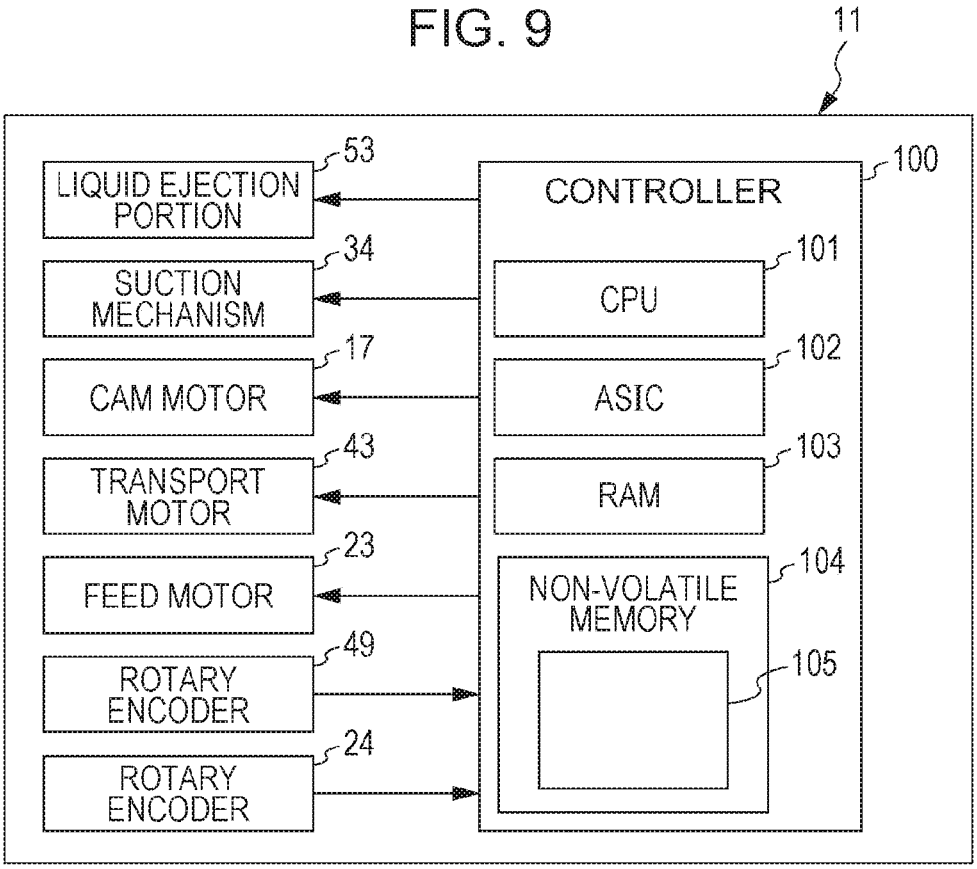
FIG. 9 is a block diagram indicating an electrical configuration of a printing apparatus.

As shown in FIG. 9, the controller 100 includes a CPU 101 (central processing unit), an ASIC 102 (application specific integrated circuit), a RAM (random access memory) 103, and a non-volatile memory 104 as an example of a storage unit. Output terminals of the controller 100 are electrically connected to the liquid ejection portion 53, the suction mechanism 34, the cam motor 17, the transport motor 43, and the feed motor 23. Input terminals of the controller 100 are electrically connected to the rotary encoders 24 and 49.

The non-volatile memory 104 stores programs for controlling the liquid ejection portion 53, the suction mechanism 34, the cam motor 17, the transport motor 43, and the feed motor 23 and also stores a table 105 in which kinds of media M and the positions of the retaining member 71 commensurate with the kinds of media M are saved. The controller 100 controls the liquid ejection portion 53, the suction mechanism 34, the cam motor 17, the transport motor 43, and the feed motor 23 on the basis of programs stored in the non-volatile memory 104 and signals that the rotary encoders 24 and 49 output.

For example, when the printer 50 performs printing on the medium M, the controller 100 executes the transport of the medium M in the transport direction Y by driving the transport motor 43 while driving the suction mechanism 34 for suction of the medium M. Along with the operation of transporting the medium M, the controller 100 drives the feed motor 23 so as to unwind and feed the medium M from the roll body 21. During the intervals between intermittent transports of the medium M, the controller 100 controls the liquid ejection timing of the liquid ejection portion 53 to execute the printing on the medium M.

Note that, for the transport of the medium M in the transport direction Y and the printing thereon, the controller 100 controls the transport distance of the medium M on the basis of the amount of rotation of the driving roller 46 detected by the rotary encoder 49. Furthermore, for the transport of the medium M in the transport direction Y, the controller 100 reads from the table 105 the position of the retaining member 71 commensurate with the kind of the medium M set for printing and then drives the cam motor 17 to move the retaining member 71 to the position (the first pressing position, the second pressing position, or the third pressing position) commensurate with the kind of the medium M.

Next, a de-skew process that the transport apparatus 40 executes prior to the operation of transporting the medium M in the transport direction Y at the time of printing will be described.

To set the medium M for printing in the printing apparatus 11, a state in which a distal end of the medium M unwound from the roll body 21 is nipped by the transport roller pairs 41 is established by manual operation by the user or the like.

At this time, the medium M unwound from the roll body 21 can sometimes bend and lift off the transport path or be oblique to the transport direction Y as indicated by solid lines in FIG. 2. If such a distorted posture of the medium M is not corrected before the transport of the medium M is started, a skew in which the medium M is transported in an inclined posture relative to the transport direction Y may possibly occur or the lifted-off medium M may possibly contact and stain the liquid ejection portion 53. If the skewing medium M is subjected to printing or the medium M is smudged, the print quality degrades.

Figure 10:
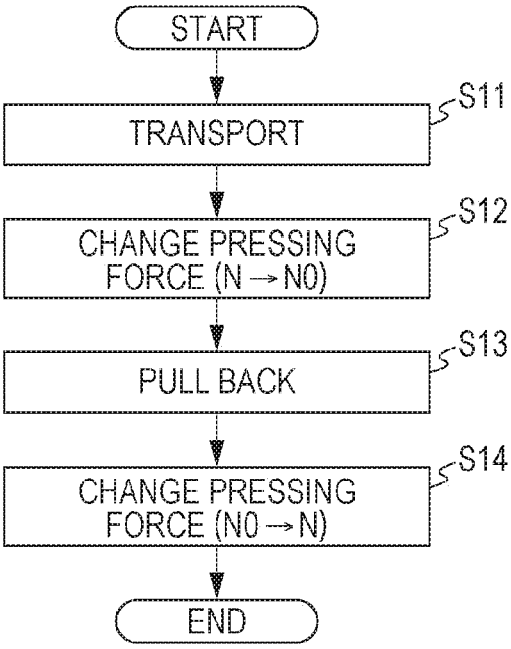
FIG. 10 is a flowchart illustrating a procedure of a de-skew process that the transport apparatus executes.

Therefore, during the time from when the medium M is set in the printing apparatus 11 to when printing starts, the controller 100 causes the transport apparatus 40 to execute a de-skew process shown in FIG. 10 as an operation of making the posture of the medium M appropriate (i.e., adjusting the posture of the medium M). It is assumed herein that when the medium M is set in the printing apparatus 11 with its distal end nipped by the transport roller pairs 41, the retaining member 71 is positioned at the position (the first pressing position, the second pressing position, or the third pressing position) commensurate with the kind of the medium M.

First, the controller 100 causes the driving roller 46 and the roll body 21 to rotate in the first rotation direction and the feed direction, respectively, so that the medium M is transported a certain distance Fd in the transport direction Y (step S11). At this time, the driving roller 46 is rotated by a greater drive force than the roll body 21. When the controller 100 determines that the transport distance of the medium M has become equal to the distance Fd on the basis of the amount of rotation of the driving roller 46 detected by the rotary encoder 49, the controller 100 stops driving the transport motor 43 and the feed motor 23.

Then, the controller 100 drives the cam motor 17 to shift the retaining member 71 to the weak pressing position (step S12). If a pressing force N (N is N1, N2, or N3) is assumed to be exerted by the driven rollers 48 when the retaining member 71 is in the first pressing position, the second pressing position, or the third pressing position, that is, when the medium M is transported in the transport direction Y, the controller 100 changes the pressing force from N to N0 in step S12.

Subsequently, the controller 100 causes the driving rollers 46 and the roll body 21 to rotate in the second rotation direction and the pull-back direction, respectively, to pull back the medium M a certain distance Fd (step S13). At this time, the roll body 21 is rotated by a greater drive force than the driving roller 46. When the controller 100 determines that the pull-back distance of the medium M has become equal to the distance Fd on the basis of the amount of rotation of the roll body 21 detected by the rotary encoder 24, it is preferable that the controller 100 stop driving the transport motor 43 and the feed motor 23. The pull-back of the medium M may be stopped when it is determined that the pull-back distance of the medium M has become equal to the distance Fd on the basis of a result of detection from one of the rotary encoders 24 and 49.

Furthermore, when the medium M is pulled back, the drive force of the suction mechanism 34 is preferred to be less than when the medium M is transported in the transport direction Y. Incidentally, the distance Fd of transport or pull-back of the medium M and the drive forces on the suction mechanism 34 and the feed motor 23 at the time of pull-back may be changed according to the kind of the medium M and the degree of skew.

After that, the controller 100 drives the cam motor 17 to return the position of the retaining member 71 to an original position of the retaining member 71 (the first pressing position, the second pressing position, or the third pressing position) (step S14). That is, in step S14, the controller 100 changes the pressing force from N0 to N. Then, the controller 100 ends this process. Incidentally, if the posture of the medium M cannot be sufficiently adjusted by performing the de-skew process once, the de-skew process may be performed a plurality of times.

Next, operation and advantage of the transport apparatus 40 and the printing apparatus 11 constructed as described above will be described.

In the transport apparatus 40 provided in the printing apparatus 11, when the medium M is transported in the transport direction Y by the driving roller 46 in order to perform printing or the like, the changers 47 change the pressing force of the driven rollers 48 according to the kind of the medium M, so that an accuracy in transporting the medium M can be secured.

Furthermore, in the printing apparatus 11, before the medium M is transported and subjected to printing, the transport apparatus 40 performs the de-skew process in which the feeder 20 pulls back the medium M after the changers 47 have changed the pressing force to the minimum value N0, which is smaller than the value of the pressing force set for the transport of the medium M, so that an appropriate posture of the medium M is obtained. This substantially prevents an event in which when the medium M is transported, the medium M bends and contacts the liquid ejection portion 53 so that the liquid ejection portion 53 is damaged or the medium M is smudged. Furthermore, due to correction of the skew, degradation of print quality can be prevented.

In the de-skew process, the controller 100 causes the driving roller 46 and the feeder 20 to execute the transport of the medium M over the distance Fd in the transport direction Y on the basis of the amount of rotation of the driving roller 46, and then causes the driving roller 46 and the feeder 20 to execute the pull-back of the medium M over the distance Fd on the basis of the amount of rotation of the roll body 21. Therefore, in the pull-back process, the posture of the medium M can be adjusted by rotating the roll body 21 with a greater drive force than the driving rollers 46 so as to rewind the medium M without allowing a bend or the like of medium M, and an event in which the medium M is excessively pulled back and escapes the nip between the transport roller pairs 41 can be prevented.

Thus, because the leading edge of the medium M is kept nipped by the transport roller pairs 41 when the de-skew process is performed, the posture of the medium M can be adjusted regardless of whether or not the leading edge of the medium M is substantially straight and orthogonal to the side edges thereof. Furthermore, after the posture of the medium M is adjusted, it is not necessary to perform an operation of causing the transport roller pairs 41 to nip the medium M again. That is, the de-skew process can be immediately followed by the printing process.

When the de-skew process is to be performed, the transport apparatus 40 changes the pressing force of the driven rollers 48 to the value N0 that is smaller than the value of the pressing force set for the transport of the medium M in the transport direction Y, so that the medium M can be kept nipped without impeding the pull-back of the medium M.

When the pressing force on the medium M is reduced in this manner, it is usually difficult to uniformly set the values of the pressing force of the driven rollers 48 with high accuracy.

However, in this exemplary embodiment, each changer 47 includes the spring 73 that, when stretched, provides the pressing force of the driven rollers 48, and changes the pressing force of the driven rollers 48 to a minimum value that corresponds to the initial tension of the spring 73 when the feeder 20 pulls back the medium M. Since the value that corresponds to the initial tension of the spring 73 is adopted as the weakest pressing force N0 as described above, the small pressing force N0 can be accurately set. Furthermore, since the value that corresponds to the initial tension of the spring 73 is set as the pressing force N0, the pressing force N0 can be set at the smallest value of the urging force that can be obtained from the spring 73.

For more specific explanation, let it assumed that a first spring that has an initial tension Nf and a second spring that does not have any initial tension have the same spring constant. Then, in order to obtain an extension of 1 mm from the natural length, the first spring requires a load that is larger by the amount of the initial tension Nf than the load that the second spring requires. That is, even when it is necessary to obtain a small pressing force N0 that corresponds to a small extension from the natural length, the first spring requires a relatively large load similar to the initial tension Nf and, therefore, it is easier to adjust load on the first spring.

Furthermore, as for adjustment of the pressing force N for the transport of the medium M in the transport direction Y, the spring 73 is stretched by using the retaining member 71, which functions as a third-class lever in which the force that acts at the point of load PL is smaller than the force exerted at the point of effort PE, so that fine adjustment of the pressing force N can be accurately performed according to the thickness of the medium M.

The foregoing exemplary embodiment achieves advantages as follows.

(1) For example, when the medium M is set in the transport path with its leading edge portion being bent or oblique to the transport direction Y, the posture of the medium M can be made appropriate and straight in the transport direction Y by the feeder 20 performing the pull-back of the medium M. If, at this time, the driven rollers 48 are apart from the driving rollers 46, the medium M is pulled back while remaining bent and thus cannot assume an appropriate posture. On another hand, if the pressing force of the driven rollers 48 on the medium M is large, the pull-back of the medium M is impeded. In the foregoing exemplary embodiment, however, when the feeder 20 pulls back the medium M, the driven rollers 48 press the medium M against the driving rollers 46 by a pressing force that is smaller than the pressing force exerted during the transport of the medium M, so that it is possible to smoothly pull back the medium M while correcting the posture of the medium M. Since the feeder 20 pulls back the medium M while the medium M is nipped between the driving rollers 46 and the driven rollers 48, the posture of the medium M can be adjusted regardless of the shape of the leading edge of the medium M. Thus, because the transport apparatus 40 operates so as to adjust the posture of the medium M, degradation of the accuracy of printing on the medium M can be inhibited.

(2) When the medium M is transported in the transport direction Y, the transport distance of the medium M is controlled on the basis of the amount of rotation of the driving rollers 46 disposed downstream of the feeder 20 in the transport direction Y, so that the medium M can be transported without causing the medium M to bend. On the other hand, when the medium M is pulled back, the pull-back distance of the medium M is controlled on the basis of the amount of rotation of the roll body 21 held by the feeder 20, so that the medium M can be pulled back without causing the medium M to bend and without excessively pulling back the medium M so that the medium M escapes the nip between the driving rollers 46 and the driven rollers 48. As the feeder 20 pulls back and rewinds the medium M onto the roll body 21, the bend of the medium M can be removed and the skew of the medium M can be corrected.

(3) The spring 73 has an initial tension and does not stretch unless a load larger than the initial tension is applied. Thus, in order to stretch the spring 73 from the natural length to obtain a pressing force as mentioned above, it is necessary to apply a larger load on the spring 73 than a spring that does not have an initial tension. Therefore, even when a small pressing force needs to be provided, the load that needs to be applied to the spring 73 in order to provide the needed pressing force is greater than the initial tension of the spring 73. Therefore, it is easier to adjust the load in this case than in the case where a small load substantially equal to the small pressing force is applied to a spring. Therefore, by setting the pressing force for the pull-back to a value that corresponds to the initial tension of the spring 73, a small pressing force onto the medium M can be accurately set.

(4) Since the spring 73 is stretched as the retaining member 71 is pivoted by the pressurizing force from the cam member 66, the changers 47 can change the pressing force due to operation of the cam member 66. To produce the pressing force as described above, the retaining member 71 functions as a "lever" whose point of effort is in a portion of the retaining member 71 that receives the pressurizing force from the cam member 66 and whose fulcrum is in a proximal end of the retaining member 71 and whose point of load is in a distal end of the retaining member 71. Therefore, if the position of the proximal end (fulcrum) supported by the pivoting member 61 is changed, the distance between the point of effort and the point of load changes. Therefore, even when the cam member 66 pressurizes the point of effort with a fixed pressurizing force, it is possible to adjust the length of stretch of the spring 73, that is, adjust the pressing force, by changing the force that acts at the point of load. On the other hand, if the position of the proximal end of the retaining member 71 is changed, the length of the spring 73 does not change. Therefore, the range of change of the pressing force is small when the spring 73 provides a small pressing force without stretching to a considerable extent. Therefore, even when the position of the proximal end of the retaining member 71 is changed, the change in the weak pressing force for pulling back the medium M can be restrained.

The foregoing exemplary embodiment may be changed as in the following modifications. Note that the foregoing exemplary embodiment and the following modifications may be combined in any desired manner.

In the case where, before the de-skew process shown in FIG. 10 starts, the leading edge of the medium M is at such a position that if the medium M is pulled back the predetermined distance Fd, the medium M will not escape the nip between the transport roller pairs 41, the transport process of step S11 may be omitted.

The spring 73 is not limited to a coil spring but may be, for example, a leaf spring that is formed by bending a thin plate so as to have as an initial tension an internal force that can hold a bent shape.

The pattern of changes in the pressing force set for the transport of the medium M may be changed as desired. For example, the pressing force for the transport of the medium M may be fixed and the changers 47 may be designed to change the pressing force between the fixed pressing force and the pressing force N0 set for the pull-back of the medium M.

The driving rollers 46 do not need to be rotating bodies that have a regular cylindrical shape; for example, a plurality of rollers and endless belts wrapped around the rollers may be adopted as driving rollers.

The driven rollers 48 do not need to be bodies of revolution that have a regular cylindrical shape but may be, for example, rollers that, when viewed in an axis direction, have a D shape such that a portion of the periphery is a non-contact portion that does not contact the medium. In this case, the driven rollers can be used also as pickup rollers that separate and feed the uppermost medium from a plurality of stacked media.

Guide members that guide the side ends of the medium M may be disposed along the first support portion 31 or the second support portion 32. In this case, during the de-skew process, the medium M is guided by the guide members while being pulled back, so that the skew of the medium M can be corrected. Note that, in this case, the feeder 20 may be designed, without employing the holder portion 22, to feed a cut-sheet medium M provided not as a roll.

The printer 50 may also be a so-called full line type printer that does not include the carriage 52 but includes an elongated fixed print head that covers the entire width of the medium M. In this case, the print head may be formed by juxtaposing a plurality of unit head portions each provided with nozzles so that the head's printing range covers the entire width of the medium M or may also be made up of a single elongated head in which a multiple number of nozzles are arranged so that the head's printing range covers the entire width of the medium M.

The recording material for use for printing is not limited to ink but may also be a fluid other than ink (that includes a liquid, a liquid material obtained by dispersing or mixing particles of a functional material in a liquid, a fluidal material such as a gel, and a solid that can flow and be ejected as a fluid). The printer apparatus of the invention may also be constructed to perform recording by ejecting a liquid material in the form of dispersion or solution which contains a material such as a color material (pixel material) or an electrode material for use in, for example, production of a liquid crystal display, an EL (electroluminescence) display, a surface-emitting display, etc.

The printing apparatus may be a fluidal material ejecting apparatus that ejects a fluidal material such as a gel (e.g., a physical gel), a powder and granular material ejecting apparatus (e.g., a toner jet type recording apparatus) that ejects a solid, for example, a powder (powder and granular material) such as a toner, etc. In this specification, the "fluid" does not include a fluid made up only of a gas, and includes, for example, liquids (such as inorganic solvents, organic solvents, solutions, liquid resins, liquid metals (metal melts), etc.), liquid materials, fluidal materials, powder and granular materials (such as granules, powders).

The printing apparatus 11 is not limited to a printer that performs recording by ejecting a fluid such as an ink but may also be, for example, a non-impact printer such as a laser printer, an LED (light emitting diode) printer, or a thermal transfer printer (that includes a sublimation type printer) or an impact printer such as a dot impact printer.

The medium is not limited to a paper sheet but may also be a plastic film, a thin plate, etc., and may also be a cloth for use in a textile printing apparatus or the like.

The transport apparatus 40 may be mounted not only in the printing apparatus 11 but also in, for example, an apparatus that performs reading on the medium M that has been transported, such as a scanner, a facsimile, a copying apparatus, or a multifunction machine that includes these apparatuses.

What is claim is:

1. A transport apparatus comprising:

a driving roller that transports a medium in a transport direction;

a driven roller that presses the medium against the driving roller when the medium is transported;

an alteration portion that alters a pressing force by which the driven roller presses the medium against the driving roller;

a feeder portion configured to feed the medium toward the driving roller and pull-back the medium in a direction opposite to the transport direction;

a control portion that controls the driving roller and the feeder;

a first detection portion that detects an amount of rotation of the driving roller; and a second detection that detects an amount of rotation of the feeder portion, wherein the feeder portion rotatably holds a roll body that has a medium in a rolled form, wherein when a posture of the medium is adjusted, the following processes are performed:

(i) the control portion causes the driving roller and the feeder portion to execute the transport of the medium over a predetermined distance in the transport direction based on a detection result of the first detection portion, (ii) when the control portion determines that a pull-back distance has become equal to the predetermined distance, the control portion stops rotation of the driving roller and rotation of the feeder portion such that pull-back of the medium is finished, and (iii) wherein when the pull-back of the medium is performed by the feeder portion, before the driving roller transports the medium, the alteration portion changes the pressing force to a value that is smaller than the value of the pressing force set for transport of the medium.

2. The transport apparatus according to claim 1, wherein:

the alteration portion includes a spring that provides the pressing force when stretched; and when the feeder portion pulls back the medium, the alteration portion alters the pressing force to a value that corresponds to the initial tension of the spring.

3. The transport apparatus according to claim 1, wherein the alteration portion includes:

a cam member;

a spring that provides the pressing force when stretched;

a pivoting member that supports the driven roller for pivotal movement, is connected to a first end of the spring, and is pivotable about a pivot shaft; and a retaining member whose proximal end is supported for pivotal movement by the pivoting member and whose distal end retains a second end of the spring and which, when receiving between the proximal end and the distal end a pressurizing force of the cam member, pivots about the proximal end in such a direction that the distal end stretches the spring, and wherein the retaining member is supported by the pivoting member in such a manner that position of the proximal end is changeable without changing the length of the spring.

4. A printing apparatus comprising:

the transport apparatus according to claim 1; and a printer that performs printing on the medium transported by the transport apparatus, the printer being positioned downstream in the transport direction relative to the transport apparatus.

5. A transport apparatus comprising:

a driving roller that transports a medium in a transport direction;

a driven roller that presses the medium against the driving roller when the medium is transported;

a changer that changes a pressing force by which the driven roller presses the medium against the driving roller comprising:

a cam member;

a spring that provides the pressing force when stretched;

a pivoting member that supports the driven roller for pivotal movement, is connected to a first end of the spring, and is pivotable about a pivot shaft; and a retaining member whose proximal end is supported for pivotal movement by the pivoting member and whose distal end retains a second end of the spring and which, when receiving between the proximal end and the distal end a pressurizing force of the cam member, pivots about the proximal end in such a direction that the distal end stretches the spring, wherein the retaining member is supported by the pivoting member in such a manner that position of the proximal end is changeable without changing the length of the spring; and a feeder configured to feed the medium toward the driving roller and pull back the medium in a direction opposite to the transport direction, wherein before the driving roller transports the medium, the feeder pulls back the medium after the changer has changed the pressing force to a value that is smaller than the value of the pressing force set for transport of the medium.

* * * * *